US005518167A

United States Patent [19]

Capy et al.

[11] Patent Number: 5,518,167

[45] Date of Patent: May 21, 1996

[54] WRAPPING METHOD USING PLEATED FLEXIBLE SHEETS

[75] Inventors: Gilbert Capy, Jarnioux, France; Akiva Buchberg, Miami Beach, Fla.

[73] Assignee: Wrapco International N.V., Curacao, Netherlands Antilles

[21] Appl. No.: 119,055

[22] PCT Filed: Mar. 13, 1992

[86] PCT No.: PCT/FR92/00228

§ 371 Date: Sep. 15, 1993

§ 102(e) Date: Sep. 15, 1993

[87] PCT Pub. No.: WO92/16429

PCT Pub. Date: Oct. 1, 1992

[30] Foreign Application Priority Data

Mar. 15, 1991 [FR] France ..... 91 03415

[51] Int. Cl.[6] ..... B65D 65/12

[52] U.S. Cl. ..... 229/87.03; 229/87.08; 383/120

[58] Field of Search ..... 383/120, 105, 383/112, 118, 907; 229/87.03, 928, 67.3, 87.02, 90, 87.08; 150/154

[56] References Cited

U.S. PATENT DOCUMENTS

| | | | |
|---|---|---|---|
| D. 309,050 | 7/1990 | Wolak | 229/67.3 X |
| 698,600 | 4/1902 | Wallace | 229/928 X |
| 1,505,012 | 8/1924 | Distefano | 383/120 X |
| 1,555,115 | 9/1925 | Hand | 383/120 X |
| 1,846,585 | 2/1932 | Clark | 229/87.03 X |
| 1,940,596 | 12/1933 | Koppelman | 229/87.02 |
| 2,364,943 | 12/1944 | Brandt | 383/120 X |
| 2,586,078 | 2/1952 | O'Malley | 229/87.03 X |
| 3,022,808 | 2/1962 | Silver | 150/154 |
| 3,077,295 | 2/1963 | Whiteford | 383/120 X |
| 3,078,895 | 2/1963 | Silver | 383/120 X |
| 3,291,373 | 12/1966 | Joyce | 383/120 |
| 3,495,762 | 2/1970 | Verbic | 383/120 |
| 3,834,528 | 9/1974 | Pickford et al. | 383/120 X |
| 4,795,648 | 1/1989 | Capy et al. . | |
| 5,125,564 | 6/1992 | Capy . | |
| 5,131,586 | 7/1992 | Capy . | |

FOREIGN PATENT DOCUMENTS

| | | | |
|---|---|---|---|
| 1126179 | 11/1956 | France | 383/120 |
| 9203345 | 3/1992 | WIPO | 383/120 |

*Primary Examiner*—Jes F. Pascua

*Attorney, Agent, or Firm*—Kane, Dalsimer, Sullivan, Kurucz, Levy, Eisele and Richard

[57] ABSTRACT

Wrapping for convex or similar bodies, made from a thin sheet, consisting of symmetrical folds, from which there are obtained, by folding, changes in direction making it possible to approximate, as best as possible, the profile to be wrapped and the folds of which are fastened at their ends. In order to change the direction of the folds, each rectangular strip (9) is folded on itself along an oblique line (12) enabling the internal (10) and external (11) arrises to be inverted in order to become, respectively, external arrises (13) and (14), the angle (15) formed by the oblique folding line (12) and the internal (10) and external (11) arrises determining the variation in the direction of the folds.

10 Claims, 2 Drawing Sheets

WRAPPING METHOD USING PLEATED FLEXIBLE SHEETS

BACKGROUND OF THE INVENTION

1. Field of the Invention

The invention relates to a method for wrapping a convex body, or the equivalent convex volume circumscribing any body, produced from a thin film.

2. Description of the Prior Art

Since the creation of the simple or composite rectangular paper sheet, which is used to wrap cheeses, hamburgers and bread rolls, a wrapping of pleated film has been created, the folds having an asymmetrical form and being fastened on the edges, making it possible to wrap convex bodies; this relates to Patents FR-A-2595666, FR-A-2628719 and FR-A-2668457, which describe various kinds of wrappings using pleats; in these patents, the folds are defined in the form of successive strips forming rectangles, parallelograms or elongate trapezia; having a width A and B, A being different from B.

SUMMARY OF THE INVENTION

The present invention relates to the production of pleatedwrappings produced from a strip of rectangular film in which the folds are formed of a succession of equal rectangular strips; this corresponds in the above-mentioned patents to the case A=B and in which the radius of the upper and lower circles is zero.

The wrapping, forming the subject of the invention, is produced in a preferred version from a sheet of rectangular shape having a length L and a width K.

DESCRIPTION OF THE PREFERRED EMBODIMENTS

Figure 1:
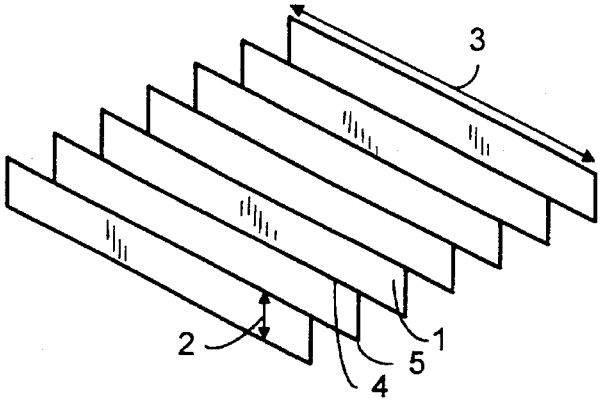
FIG. 1 shows a folding formed of symmetrical folds.
Figure 2:
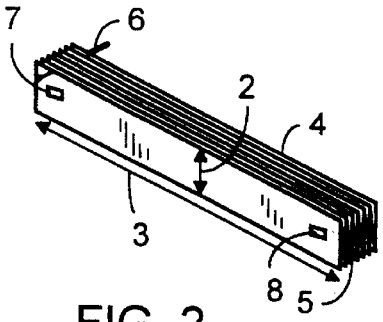
FIG. 2 shows the previous folding, the ends of which have been fastened.

When the symmetrical folds formed of identical rectangular strips 1 (FIG. 1), of width 2 and of length 3, are folded, the N folds are exactly superimposed (N being the number of folds), each fold being formed of two successive rectangular strips 1 connected together by a folding arris 4, two successive folds being also connected together by a folding arris 5; once pleated, the wrapping is in the form of a parallelepiped (FIG. 2) of length 3, width 2, and thickness 6 corresponding to the number of N folds; the thickness 6 of the folds to be fastened at their ends 7 and 8 is directly proportional to the number N of folds; the fastening techniques must be adapted according to the uses which are to be made thereof and to the number N of folds.

The folds are fastened at the ends in various ways; firstly, there are the methods for fastening sheets together, originating from book binding, such as stapling, pinching, stitching, gluing on the edge, the use of a ring passing through a hole produced with a punch, this list being non-limiting; then there are the methods of heat welding, ultrasonic sealing, electronic sewing, welding of films which are weldable or are made weldable by depositing a layer of plastic or of heat-activatable glue on one face or on both faces, this list being non-limiting. The fastening can apply to the whole width 2 of the ends 6 and 7 of the folds and both sides of the film. But it can also apply to the whole width 2 of the ends 6 and 7 of the folds, but only one side of the film; under these conditions, the faces of each fold are fastened in pairs and each fold over half of width 2 starting from the arris 4 leaving the area located on the side of the arris 5 free; the area for fastening the folds can then be partially opened out making it possible to avoid having the end of the folds bunched up together. When the end is opened out, each fold-fastening area is then separated from the next by a film strip of width 2; it forms a border making it possible to improve the appearance of the whole wrapping; however, it is important not to forget that the fastenings produced in this way are stressed in a peeling fashion when the wrapping is opened out, that the fastening remains fragile and that it is possible to cause the wrapping to be prematurely damaged.

When this wrapping is spread out, by opening out the folds in their central area, a cavity is formed in which an object can be housed. Let us assume, in order to facilitate the explanations, that the object to be wrapped is a cylindrical volume of revolution having a diameter D and a height H. In the described version, the wrapping forms, before unfolding, a right-angled parallelepiped (FIG. 2); in order to avoid having too many folds, which creates problems in fastening the ends, it is best to limit the number of folds; in the case of the wrapping of a cylinder, K is substantially equal to B+D and L=K*P1 with P1=3.14*D which corresponds to the perimeter of the cylindrical surface, K being the covering coefficient of the wrapping and A=L/N; K is less than 1 in the case of the object to be wrapped being partially covered; if K is equal or greater than 1, the object may be totally covered and the wrapping may even overlap in order to form the closing part. The maximum number of folds which is allowed depends on their method of fastening their ends and it can vary in a considerable manner. Opening out the central part of the wrapping, as it is produced, does not allow the ends to turn over systematically towards the center of the upper and lower parts of the object to be wrapped; the folds which are generally wide enough have difficulty in being opened out in order to cover the upper and lower surfaces. One way of facilitating this opening out consists, by means of an appropriate folding, in giving the foldedwrapping a more complex shape (FIG. 6); one procedure is to try to obtain folds, which no longer consist of plane rectangular strips 1 (FIG. 1) but of rectangular strips 9 (FIG. 6) which are folded over themselves so as to give them a direction chosen in advance; for example, the folded wrapping may be given (FIG. 6) the shape of a crescent by making two changes in direction; in order to obtain this result, the following is carried out: in their central part 25 (FIGS. 6 and 7), the folds are of the same nature as those described previously with an internal arris 10 which will be in contact with the object to be covered and an external arris 11 which separates two successive internal arrises 10; in order to change the direction of the folds, each rectangular strip 9 is folded over itself along a line 12 joining, in an oblique fashion, the two sides of length 3 forming two successive internal 10 and external 11 arrises, and two successive strips 1 being folded symmetrically, one with respect to the other, in relation to their common arris 10 or 11, under these conditions, the arrises are inverted; the internal arrises 10 become external arrises 13 and the external arrises 11 become internal arrises 14; the angle 15 formed by the oblique folding line 12 and the internal 10 and external 11 arrises determines the variation in the direction of the folds, which can vary within a large range, from acute angle to obtuse angle via right angle. If the same change in direction is carried out at the two ends 16 and 17 in order to obtain a folded profile in the shape of a U or of a crescent, so as to approximate, as best as possible, the half-profile of the product to be wrapped, it is thus possible to obtain, by unfolding the correctly dimensioned wrapping, for example, around a cylindrical surface (FIG. 7), substantially parallel open folds 18 which remain properly formed along the cylindrical surface and folds 19 which are substantially radiating but properly formed over the upper and lower parts. In order to produce this type of wrapping and to enable it to keep its appearance, it is necessary that it is sufficiently dimensioned; indeed, its design makes it into a wrapping which makes it possible to produce a cavity having a relatively well defined shape; and if it is desired to use it to wrap a shape which is too different from that for which it was dimensioned, there is a risk of losing the aesthetic quality of the folds. Unlike the wrappings described in the abovementioned patents, the folds open in concertina fashion without the film slipping over itself; consequently, it is possible to use films which are relatively more rigid.

It is clear that it is possible to apply this technique to folds formed initially, for example, of strips in the shape of parallelograms which are symmetrical in pairs or of isosceles trapezia which are equal and symmetrical in pairs, along the oblique side joining the two parallel bases, which can be superimposed by folding, make several successive changes in direction, this list of possibilities being non-limiting.

Figure 3:
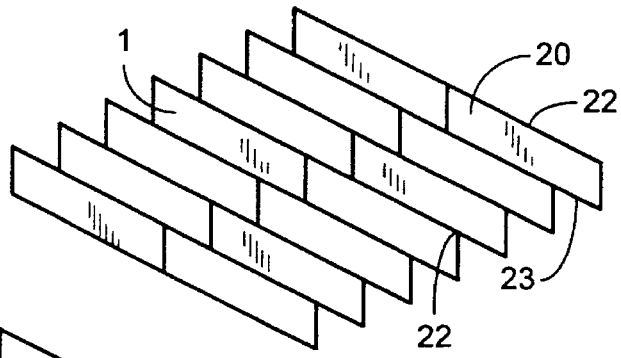
FIG. 3 shows a folding of the type of FIG. 1 produced on a sheet of which one side has been folded over longitudinally in order to form a double film thickness.
Figure 4:
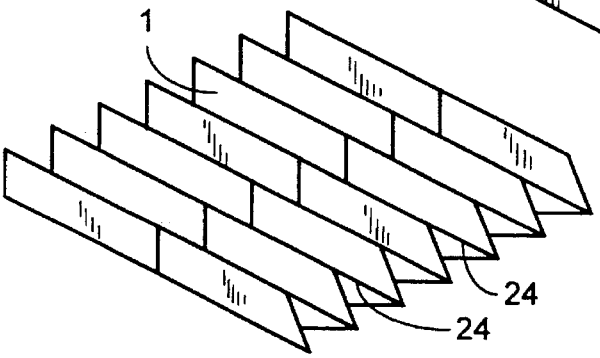
FIG. 4 shows the folding of FIG. 3, one corner of which has been pushed in, in the zone where there are two film thicknesses.
Figure 5:
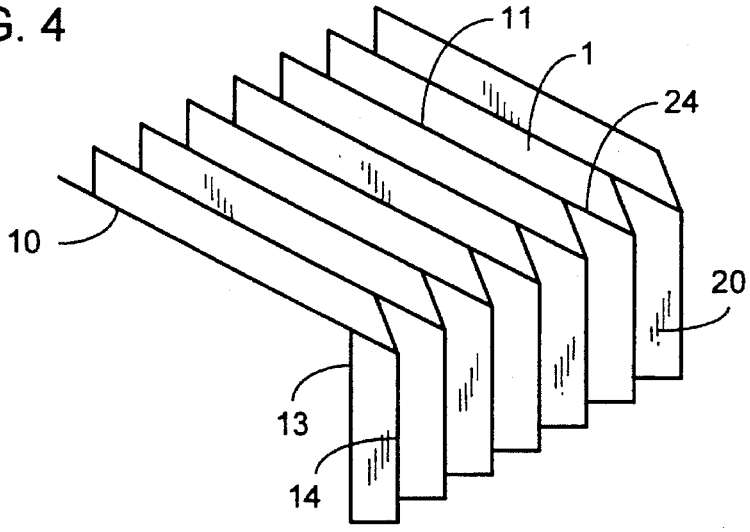
FIG. 5 shows the folding of FIG. 3 opened out in order to obtain a change in direction of the folds according to the invention.
Figure 8:
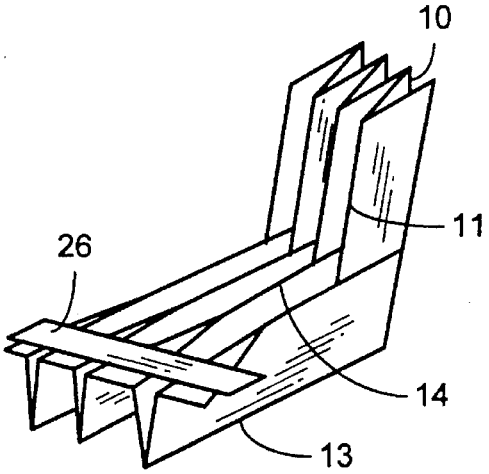
FIG. 8 shows a mechanism of fastening the folds with tape.
Figure 6:
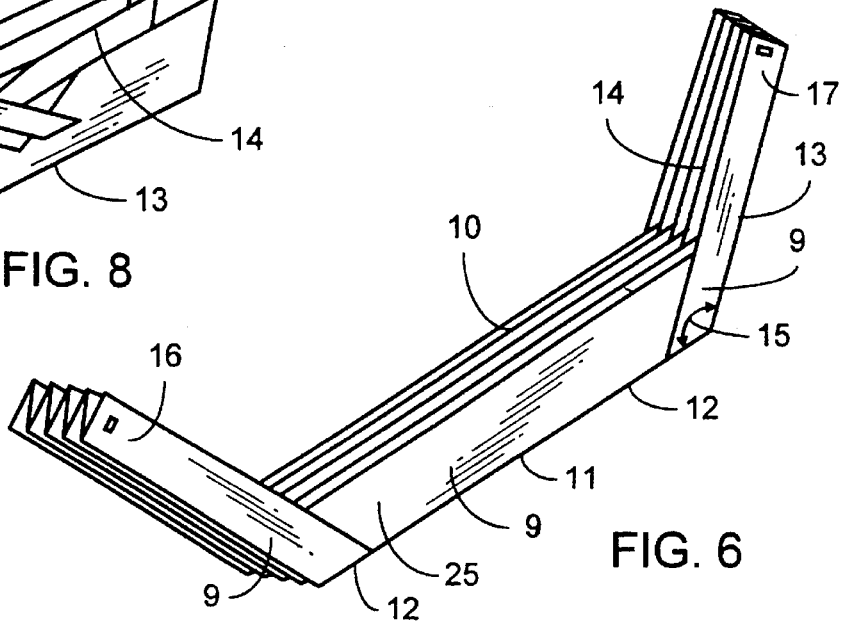
FIG. 6 shows a wrapping according to the invention comprising two changes in direction.
Figure 7:
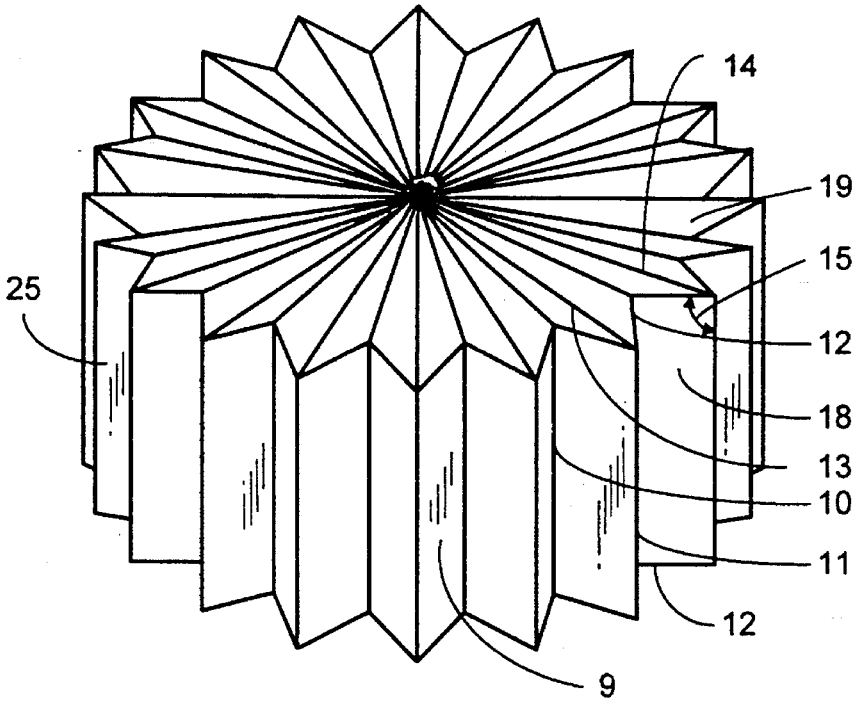
FIG. 7 shows a wrapping according to the invention opened out around an object.

One way of manually producing this type of folding with change in direction is to firstly delimit strips of width 2 and of length 3 (FIG. 3); longitudinally fold over the end 20 whose direction is to be changed, and carry out the folding as described previously of the rectangles 1 (FIG. 1), one side 20 of which (FIG. 3) comprises two film thicknesses with a folding arris 23. Each corner 22 of the folds obtained is then pushed in in order to mark the oblique line 24 (FIG. 4) which will enable each strip 1 to be folded over on itself; once the arrises are well marked, the previous folding (FIG. 4) is unfolded and the folds are positioned according to the grooves produced (FIG. 5); there then remains to fold the folds over each other and to fasten the ends as indicated (FIG. 6). It is noted that in the area of change in direction, the number of superimposed layers of films is doubled, which is a factor limiting the number of folds. In a variant of the invention, it can be advantageous, for certain applications, to fasten only one of the ends in order to make products, having the shape of a bell or of a cone, when they are opened out, in order to protect, for example, an object laid on a table, from dust or simply a cone for chips. FIG. 8 shows a method for fastening the folds or for reinforcing their fastening by adding a flexible tape. This flexible tape 26 (FIG. 8) is fastened by welding or gluing and avoids the fastening of the folds being stressed in a peeling fashion in the vicinity of the arris 13 when it applies only to one face of the film; the strip can by itself form a method for fastening the folds.

We claim:

1. Pleated wrapping for convex bodies comprising a strip of rectangular film, the film comprising a succession of equal rectangular superimposed strips (1) with each strip connected to a neighboring strip by a fold (4, 5: 13, 14) and there being an internal fold and external fold; the superimposed strips having opposed connected ends, each strip being folded upon itself along an oblique line (12, 24) to form a first strip part and a second strip part and enabling the internal and external folds to become, respectively, an external and internal fold thereby changing the direction of the second strip part relative to first strip part, means for permitting the strip to be unfolded between the connected ends to open out the wrapping to wrap a convex body.

2. Wrapping according to claim 1, characterised in that the folds change direction by folding the strips over themselves along an oblique line (12) enabling the internal (10) and external (11) folds to be inverted in order to become respectively external folds (13) and (14).

3. Wrapping according to claim 2, characterized in that the ends (16) and (17) of the strips change direction in order to form a U, when the strip is folded, so that the folds maintain an aesthetic appearance, when the wrapping is opened out around the object to be covered.

4. Wrapping according to claim 2 characterized in that the change in direction of the folds are produced by longitudinally folding a strip (20) beforehand, along a fold (23) of the film before the folding into symmetrical folds to form corners (22) and then by pushing in the corners, in order to mark the oblique lines (24), before opening out, enabling the internal (10) and external (11) folds to be inverted, respectively, into external (13) and internal (14) folds.

5. Wrapping according to claim 1 characterised in that the folds comprise a change in direction.

6. Wrapping according to claim 1, characterised in that the connected ends are produced by employing hot-welding techniques.

7. Wrapping according to claim 1 characterised in that each strip has two faces and the ends are connected by fastening the ends of the strips forming the folds on their two faces.

8. Pleated wrapping for convex bodies comprising a strip of rectangular film, the film comprising a succession of equal rectangular superimposed strips (1) with each strip connected to a neighboring strip by a fold (4, 5: 13, 14) and there being an internal fold and external fold; the superimposed strips having opposed connected ends, each strip being folded upon itself along an oblique line (12, 24) to form a first strip part and a second strip part and enabling the internal and external folds to become, respectfully, an external and internal fold thereby changing the direction of the second strip part relative to first strip part means for permitting the strip to be unfolded between the connected ends to open out the wrapping to wrap a convex body, the film having opposed faces and the ends are fastened only on one face of the film so that two successive strips connected by a folding fold (4) are fastened together at their ends on the one face and are free of fastening on the other face.

9. Wrapping according to claim 8 characterised in that the connecting of the ends is on a part of the width of the strips and leaves part of the strips free so as to enable the folds to be partially moved apart.

10. Wrapping according to claim 9, characterised in that the connection of the ends is reinforced by a flexible tape (26).

* * * * *